US010336113B2

(12) United States Patent
Motoyama

(10) Patent No.: US 10,336,113 B2
(45) Date of Patent: Jul. 2, 2019

(54) THERMAL PRINTER, AND THERMAL PRINTER CONTROL METHOD

(71) Applicant: SEIKO EPSON CORPORATION, Tokyo (JP)

(72) Inventor: Hiroyuki Motoyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 15/602,982

(22) Filed: May 23, 2017

(65) Prior Publication Data

US 2017/0341445 A1 Nov. 30, 2017

(30) Foreign Application Priority Data

May 24, 2016 (JP) ..... 2016-102965

(51) Int. Cl.
*B41J 29/393* (2006.01)
*B41J 2/345* (2006.01)

(52) U.S. Cl.
CPC ..... *B41J 29/393* (2013.01); *B41J 2/345* (2013.01)

(58) Field of Classification Search
CPC combination set(s) only.
See application file for complete search history.

(56) References Cited

U.S. PATENT DOCUMENTS 4,369,354 A * 1/1983 Goedecke ..... G05D 23/19 219/216
4,387,150 A * 6/1983 Yabuta ..... G03C 1/60 430/151
4,453,166 A * 6/1984 Enoto ..... B41J 2/35 347/171
4,595,935 A * 6/1986 Brooks ..... B41J 2/35 347/171
4,625,216 A * 11/1986 Brooks ..... B41J 2/35 347/171
4,758,966 A * 7/1988 Brooks ..... B41J 2/37 219/216
4,769,657 A * 9/1988 Takahashi ..... B41J 2/35 219/482

(Continued)

FOREIGN PATENT DOCUMENTS

JP 08-187881 A 7/1996
JP 2002-127488 A 5/2002
JP 2003-320698 A 11/2003

*Primary Examiner* — Matthew Luu
*Assistant Examiner* — Lily K Kemathe
(74) *Attorney, Agent, or Firm* — Foley & Lardner

(57) ABSTRACT

A thermal printer comprises: a thermal line head configured to include a plurality of resistors and prints an image based on a received print data on thermosensitive paper, the plurality of resistors being divided into unit of being able to be energized concurrently; and a head element inspection unit configured to perform inspection, with the plurality of resistors divided into the unit, to acquire a resistance value of each resistor belonging to the unit on a unit-by-unit basis; wherein, when the image is not being printed, the head element inspection unit inspects the resistors in the unit of division each; wherein the inspection of the resistors is suspended on the unit-by-unit basis, the suspension being based on the print data; and wherein, after completion of the printing of the image, the suspended inspection is resumed on the unit-by-unit basis from where suspended.

6 Claims, 7 Drawing Sheets

(56) References Cited

U.S. PATENT DOCUMENTS

| | | | | |
|---|---|---|---|---|
| 4,774,526 | A * | 9/1988 | Ito | B41J 2/35 219/486 |
| 5,546,112 | A * | 8/1996 | Hunter | B41J 2/355 347/171 |
| 5,642,148 | A * | 6/1997 | Fukushima | B41J 2/355 347/211 |
| 5,951,175 | A * | 9/1999 | Kawamori | B41J 2/355 347/171 |
| 6,217,239 | B1 * | 4/2001 | Orita | B41J 2/32 347/171 |
| 6,738,085 | B2 * | 5/2004 | Hachinoda | B41J 2/355 347/171 |
| 7,054,017 | B2 * | 5/2006 | Terrill | G06K 5/02 345/611 |
| 7,419,231 | B2 * | 9/2008 | Parish | B41J 29/393 347/211 |
| 7,547,087 | B2 * | 6/2009 | Cato | B41J 2/0451 347/19 |
| 8,497,890 | B2 * | 7/2013 | Gu | B41J 2/355 347/171 |
| 8,899,706 | B2 * | 12/2014 | Yabuki | B41J 2/1752 347/6 |
| 9,096,072 | B1 * | 8/2015 | Saga | B41J 2/355 |
| 2002/0051050 | A1 | 5/2002 | Hachinoda | |

* cited by examiner

THERMAL PRINTER, AND THERMAL PRINTER CONTROL METHOD

This application claims priority under 35 U.S.C. § 119 to Japanese Patent Application No. 2016-102965 filed on May 24, 2016, the entire disclosure of which is expressly incorporated by reference herein.

BACKGROUND

1. Technical Field

The present invention relates to a thermal printer, and a thermal printer control method.

2. Related Art

A related-art printer that prints an image on thermosensitive paper by using a thermal line head includes an inspection apparatus that inspects whether there is a thermal line head defect or not, for example, as disclosed in JP-A-2002-127488. A printing apparatus disclosed in JP-A-2002-127488 includes a defect defector configured to detect the defect, if any, of a thermal head during blank line printing, in which one line in its entirety is blank.

However, in a case of receiving print data during the inspection of a thermal line head, it is impossible to perform printing based on the received print data until the inspection of the thermal line head finishes. Since blank line printing is performed during the inspection of a thermal line head in JP-A-2002-127488, too, no image based on print data is performed, meaning waiting before the print data is printed out.

SUMMARY

An advantage of some aspects of the invention is to provide a printer that realizes a reduction in the time of postponement, due to the inspection of a thermal line head, of the printing of print data, and provide a printer control method.

A thermal printer according to an exemplary embodiment of the invention comprises: a communication section configured to receive print data; a thermal line head configured to include a plurality of resistors and print an image based on the received print data on thermosensitive paper, the plurality of resistors being divided into unit of being able to be energized concurrently; and an inspection section configured to perform inspection, with the plurality of resistors divided into the unit, to acquire a resistance value of each resistor belonging to the unit on a unit-by-unit basis; wherein, when the image is not being printed by the thermal line head, the inspection section inspects the resistors in the unit of division each; wherein the inspection of the resistors is suspended on a basis of the print data between certain one that is the unit that has already been inspected and next one that is the unit that has not been inspected yet; and wherein, after completion of the printing of the image by the thermal line head, the suspended inspection is resumed on the unit-by-unit basis from where suspended. In the exemplary embodiment of the invention, the resistors are inspected in the unit of division each, and the inspection of the resistors is suspended on the unit-by-unit basis, wherein the suspension is based on the print data. After completion of the printing of the image by the thermal line head, the suspended inspection is resumed on the unit-by-unit basis from where suspended. Therefore, it is possible to reduce the time of postponement, due to the inspection of the thermal line head, of the printing of print data.

In a thermal printer according to an exemplary embodiment of the invention, the inspection section suspends the inspection when the print data is received by the communication section. In the exemplary embodiment of the invention, it is possible to suspend the inspection of the thermal line head when the print data is received by the communication section. Therefore, it is possible to reduce the time of postponement, due to the inspection of the thermal line head, of the printing of print data.

In a thermal printer according to an exemplary embodiment of the invention, the inspection section suspends the inspection when the image based on the print data is printed by the thermal line head. In the exemplary embodiment of the invention, it is possible to suspend the inspection of the thermal line head when the image based on the print data is printed by the thermal line head. Therefore, it is possible to reduce the time of postponement, due to the inspection of the thermal line head, of the printing of print data, and possible to continue the inspection of the thermal line head until just before the image based on the print data is printed.

A thermal printer according to an exemplary embodiment of the invention further comprises: a rendering section configured to render the print data into data printable by the thermal line head, wherein the inspection section inspects the resistors in the unit of division each in a predetermined cycle; and wherein a length of a period during which the inspection is not performed by the inspection section is preset to be greater than a length of time taken for rendering into the data of a predetermined unit amount by the rendering section. In the exemplary embodiment of the invention, the length of a period during which the inspection is not performed is preset to be greater than the length of time taken for rendering into the data of a predetermined unit amount by the rendering section. Therefore, it is possible to increase the probability that the printing of received print data will be performed without performing the inspection of the resistors in a case of receiving the print data during the period during which the inspection is not performed.

In a thermal printer according to an exemplary embodiment of the invention, upon receiving a predetermined command by the communication section, inspected status of the resistors each is acquired by the inspection section, and the communication section transmits information that indicates the acquired inspected status of the resistors each to a transmission destination specified by the predetermined command. In the exemplary embodiment of the invention, the printer performs communication and receives the predetermined command. By this means, it is possible to cause the printer to transmit the information that indicates the inspected status of the resistors to an external apparatus.

In a thermal printer according to an exemplary embodiment of the invention, in a case where the inspection of the resistors of the thermal line head by the inspection section has not finished yet when the predetermined command is received by the communication section, either information that indicates that the inspection of the resistors has not finished yet or information that indicates that the inspection of the resistors has not been confirmed yet is transmitted by the communication section to the transmission destination. In the exemplary embodiment of the invention, either information that indicates that the inspection of the resistors has not finished yet or information that indicates that the inspection of the resistors has not been confirmed yet is transmitted to the transmission destination in a case where the inspection of the resistors has not finished yet. Therefore, the apparatus at the transmission destination is able to acquire the information that indicates the inspected status of the resistors by transmitting the predetermined command to the printer again after a predetermined time interval.

A thermal printer according to an exemplary embodiment of the invention further comprises: a driving section configured to drive a motor to transport the thermosensitive paper to a print position of the thermal line head, wherein the inspection section performs the inspection of the resistors either when the motor has stopped or when the motor has been put into a hold state. In the exemplary embodiment of the invention, the inspection of the resistors is performed either when the motor has stopped or when the motor has been put into a hold state. Therefore, it is possible to judge, with high precision, the timing at which the printing of print data is not being performed.

A thermal printer control method according to an exemplary embodiment of the invention is a method for controlling a thermal printer configured to include a plurality of resistors divided into unit of being able to be energized concurrently, comprising: printing an image based on received print data by means of a thermal line head on thermosensitive paper; inspecting, with the plurality of resistors divided into the unit, each resistor belonging to the unit on a unit-by-unit basis when the image is not being printed by the thermal line head; suspending the inspection of the resistors on the unit-by-unit basis, the suspension being based on the print data; and resuming, after completion of the printing of the image by the thermal line head, the suspended inspection on the unit-by-unit basis from where suspended. In the exemplary embodiment of the invention, the resistors are inspected in the unit of division each, and the inspection of the resistors is suspended on the unit-by-unit basis, wherein the suspension is based on the print data. After completion of the printing of the image by the thermal line head, the suspended inspection is resumed on the unit-by-unit basis from where suspended. Therefore, it is possible to reduce the time of postponement, due to the inspection of the thermal line head, of the printing of print data.

BRIEF DESCRIPTION OF THE DRAWINGS

One embodiment of the invention will be described with reference to the accompanying drawings, wherein like numbers reference like elements.

DESCRIPTION OF EXEMPLARY EMBODIMENTS

First Embodiment

Figure 1:
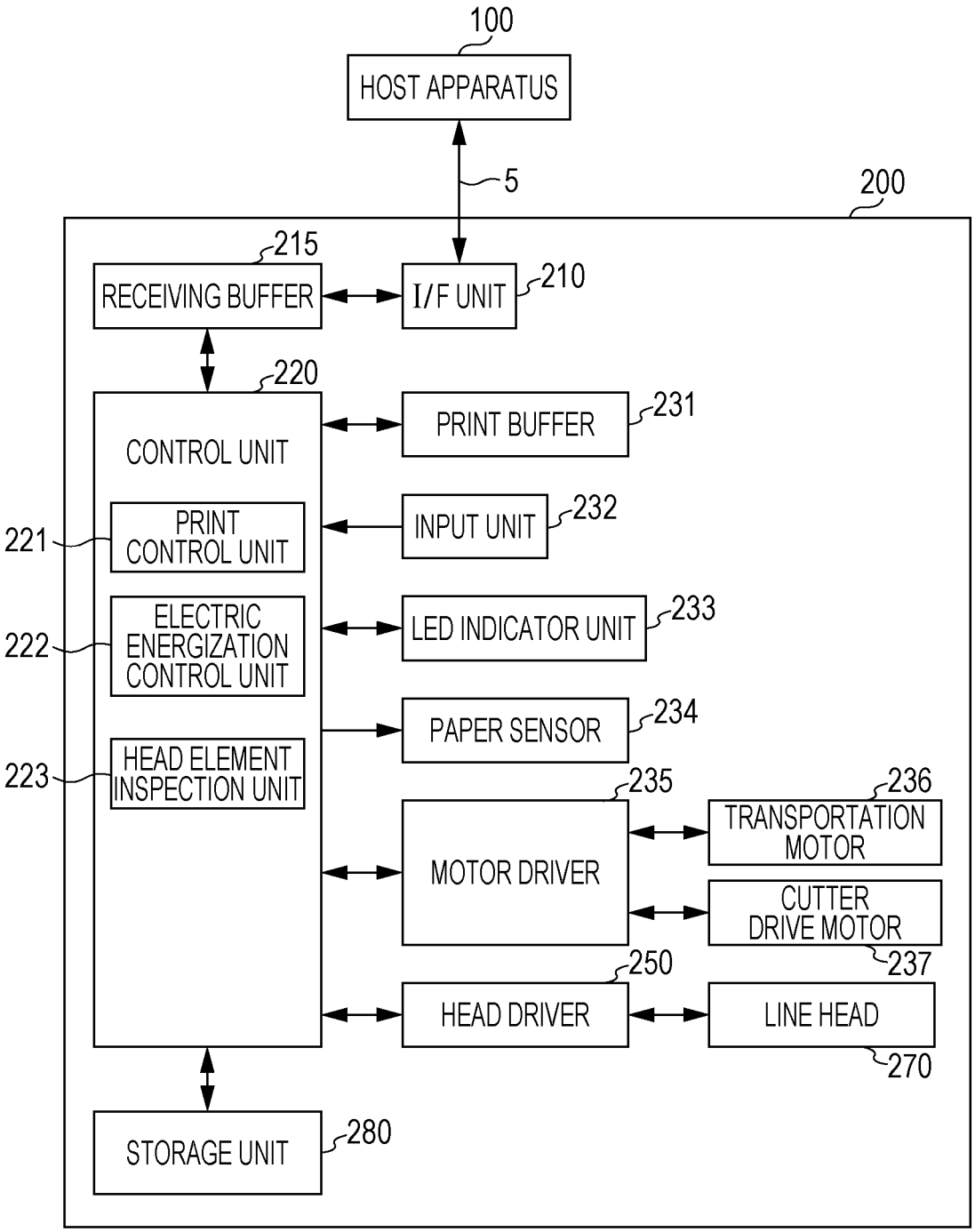
FIG. 1 is a diagram illustrating an example of the configuration of a printing system.

With reference to the accompanying drawings, a first embodiment, which is an example of embodiments of the invention, will now be explained. FIG. 1 is a diagram illustrating an example of the configuration of a printing system 1. The printing system 1 includes a host computer (hereinafter referred to as "host apparatus") 100 and a printer 200. The host apparatus 100 generates print data for printing by the printer 200, and sends the print data to the printer 200. The printer 200 analyzes the print data received from the host apparatus 100 to generate print bit data, and performs printing on a print medium. In the description below, a case where the printer 200 is a thermal printer is taken as an example, wherein the thermal printer performs printing by applying a hot thermal line head onto thermosensitive paper, the color of which changes when heat is applied. Print bit data will be described in detail later.

The host apparatus 100 and the printer 200 are connected to each other via a communication channel 5. The communication channel 5 is a communication cable or a wireless communication channel. For example, the communication channel 5 is a one-to-one communication cable conforming to a standard selected from among a variety of standards such as USB, IEEE1284, IEEE1394, RS-232C. The communication channel 5 may be a wired network conforming to Ethernet®. Alternatively, near-field wireless communication such as Bluetooth® or wireless USB or a wireless communication network such as wireless LAN may be used for the communication channel 5.

It is possible to use, for example, a desktop computer, a notebook computer, or a tablet terminal computer as the host apparatus 100. A smartphone or other mobile phone, etc. may be used as the host apparatus 100. The host apparatus 100 includes at least one control unit (at least one controller) provided with at least on CPU (at least one processor), at least one ROM, and at least one RAM, etc. and further includes a nonvolatile storage device (both not illustrated). A basic control program such as OS (Operating System) is stored in the ROM. Application software and driver software are stored in the nonvolatile storage device. The basic control program, the application software, and the driver software are loaded into the RAM. The CPU runs the loaded program and the loaded software. A print image is generated as a result of the running of the application software by the CPU. The generated print data is converted into print data for the printer 200 as a result of the running of the driver software by the CPU. The converted print data is transmitted to the printer 200 via the communication channel 5.

The host apparatus 100 transmits commands to the printer 200. The commands transmitted by the host apparatus 100 to the printer 200 include, for example, a command for acquiring status and version information of the printer 200, a command for changing the operation mode of the printer 200, and a command for acquiring inspection results of a plurality of heat generation elements provided in a thermal line head 270 (a line head) of the printer 200.

The printer 200 receives, via an interface unit (hereinafter abbreviated as "I/F unit") 210, the print data sent from the host apparatus. The I/F unit 210 corresponds to a "communication section" according to an aspect of the invention. Connected via the communication channel 5 to the host apparatus 100, the I/F unit 210 transmits data to, and receives data from, the host apparatus 100 as controlled by at least one control unit 220 (at least one controller). The printer 200 stores, into a receiving buffer 215, the print data received via the I/F unit 210 under the control of the control unit 220. Next, the control unit 220 and the receiving buffer 215 will now be explained.

The control unit 220 controls each component of the printer 200. The receiving buffer 215, a print buffer 231, an input unit 232, an LED indicator unit 233, a paper sensor 234, a motor driver 235, a head driver 250, and a storage unit 280 are connected to the control unit 220. The motor driver 235 corresponds to a "driving section" according to an aspect of the invention.

The receiving buffer 215 has a storage area for storing received print data temporarily. The print buffer 231 has a storage area into which rendered print bit data corresponding to one line is stored. Print bit data is generated on the basis of print data received by the control unit 220. Print bit data indicates whether each heat generation element provided in the thermal line head 270 should form a black dot or not. Print bit data includes pieces of bit data, the number of which corresponds to the number of the heat generation elements provided in the thermal line head 270. Each bit data is one-bit data that indicates whether the corresponding heat generation element should form a black dot or not and consists of "1", which means "electrically energized", and "0", which means "not electrically energized". The receiving buffer 215 and the print buffer 231 are storage device(s), for example, semiconductor memory. An independent storage device may be used for each of the receiving buffer 215 and the print buffer 231, or, alternatively, the RAM of the control unit 220 may be used for either one of the receiving buffer 215 and the print buffer 231, or both.

The input unit 232 is connected to a switch provided on an operation panel of the printer 200 (both not illustrated). When the switch is operated, the input unit 232 outputs an operation signal corresponding to the operated switch to the control unit 220.

The LED indicator unit 233 includes an LED. LED ON lets a user know the state of the printer 200 and the occurrence/non-occurrence of an error, etc.

The paper sensor 234 is an optical-type sensor for detecting the presence/absence of thermosensitive paper. The paper sensor 234 is located upstream of the thermal line head 270 as viewed in a direction in which thermosensitive paper is transmitted by transmission rollers (not illustrated), and outputs, to the control unit 220, a value that indicates whether thermosensitive paper is present or absent. A detection value of the paper sensor 234 is inputted into the control unit 220. On the basis of the sensor input, the control unit 220 detects absence and turns the LED of the LED indicator unit 233 ON when thermosensitive paper has run out.

A transportation motor 236, which causes the transportation roller to rotate, and a cutter drive motor 237, which causes the movable blade of a cutter mechanism (not illustrated) to operate, are connected to the motor driver 235. The transportation motor 236 and the cutter drive motor 237 are, for example, stepper motors. The transportation motor 236 corresponds to a "motor" according to an aspect of the invention. The motor driver 235 drives the transportation motor 236 as controlled by the control unit 220. The transmission roller rotates in the normal direction or the reverse direction due to the operation of the transportation motor 236, thereby transporting thermosensitive paper in the transportation direction or in the opposite direction. In addition, the motor driver 235 drives the cutter drive motor 237 as controlled by the control unit 220. Due to the operation of the cutter drive motor 237, the movable blade of the cutter mechanism moves to cut thermosensitive paper.

The head driver 250 is connected to the thermal line head 270. Under the control of the control unit 220, the head driver 250 selectively energizes the plurality of heat generation elements provided in the thermal line head 270, thereby causing the heat generation elements to generate heat.

The storage unit 280 is, for example, a nonvolatile storage such as EEPROM (Electrically Erasable Programmable Read-Only Memory) or a flash memory. The storage unit 280 stores, for example, the result of inspection conducted for each resistor by a head element inspection unit 223 described later, information on the number of lines printed by the printer 200, and the like.

The control unit 220 includes at least one CPU (at least one processor), at least one ROM, at least one RAM, and the like (not illustrated). Firmware is stored in the ROM. The firmware stored in the ROM is loaded into the RAM. The CPU reads out the loaded firmware and runs it to control each component of the printer 200. The control unit 220 (at least one processor) includes a print control unit 221 (a print controller), an electric energization control unit 222 (an electric energization control controller), and the head element inspection unit 223 (a head element inspector) as its functional blocks. For the convenience of description, the print control unit 221, the electric energization control unit 222, and the head element inspection unit 223 are depicted as blocks representing functions implemented by reading out, and running, the firmware stored in the ROM by the CPU; they do not mean any specific applications or hardware. The head element inspection unit 223 corresponds to an "inspection section" according to an aspect of the invention.

The print control unit 221 stores print data received from the host apparatus 100 into the receiving buffer 215. The print control unit 221 analyzes the stored print data to generate print bit data for each one line. The print control unit 221 renders the generated print bit data corresponding to one line onto the print buffer 231. "One line" means a line of dots in a direction in which the heat generation elements of the thermal line head 270 are arranged (hereinafter referred to as "line direction"). The line direction is orthogonal to the transportation direction of thermosensitive paper. The print control unit 221 and the print buffer 231 correspond to a "rendering section" according to an aspect of the invention. The print bit data corresponding to one line rendered onto the print buffer 231 by the print control unit 221 corresponds to "data of a predetermined unit amount" according to an aspect of the invention. For printing, the print control unit 221 causes the motor driver 235 to drive the transportation motor 236 so as to transport thermosensitive paper to the print position of the thermal line head 270. In addition, the print control unit 221 causes the motor driver 235 to drive the cutter drive motor 237 so as to cut the thermosensitive paper by means of the movable blade after printing.

On the basis of the print bit data corresponding to one line rendered onto the print buffer 231 by the print control unit 221, the electric energization control unit 222 controls the head driver 250 for selective electric energization of the heat generation elements of the thermal line head 270. By this means, an image based on the print bit data is printed on the transported thermosensitive paper.

The head element inspection unit 223 inspects each heat generation element provided in the thermal line head 270 by controlling the head driver 250, and stores the inspection results into the RAM. The method of inspection of each heat generation element by the head element inspection unit 223 will be described later. Before the printer 200 is powered OFF, the head element inspection unit 223 causes the storage unit 280 to memorize the inspection results stored in the RAM. The heat generation elements may be inspected by the head element inspection unit 223 when a command is received from the host apparatus 100; alternatively, the timing of inspection may be periodical: for example, the inspection may be conducted when the number of lines printed by the printer 200 reaches a preset number of lines (e.g., a few to ten thousands), when the period of use of the printer 200 reaches a preset period, each time when the printer 200 is powered ON, or each time when the printer 200 is powered OFF, to name but a few.

When a command for acquiring the inspection result of each heat generation element provided in the thermal line head 270 (predetermined command) is received from the host apparatus 100, the head element inspection unit 223 acquires the inspection result of each heat generation element from the RAM or from the storage unit 280. The head element inspection unit 223 transmits information that shows the acquired results of inspection to the host apparatus 100.

The inspection result acquisition command transmitted from the host apparatus 100 to the printer 200 may contain information specifying the information transmission destination (e.g., IP address). Although the control unit 220 according to the present embodiment is configured to return the information on the inspection results to the host apparatus 100, which is the sender of the received command, the information on the inspection results may be transmitted to another apparatus that is different from the sender of the received command. For example, in a configuration in which the printer 200 is connected to a tablet terminal (not illustrated) via a wireless communication channel, a command for acquiring the inspection results is transmitted from the tablet terminal to the printer 200. The printer 200 transmits the inspection results to the information transmission destination contained in the received command, for example, to the host apparatus 100 connected via the I/F unit 210.

In a case where there exists any heat generation element for which inspection has not completed yet when a command for acquiring the inspection results is received from the host apparatus 100, the head element inspection unit 223 may transmit information to the effect that inspection has not completed yet to the host apparatus 100. The head element inspection unit 223 may transmit information to the effect that the inspection of the heat generation elements is in a "yet-to-be-confirmed" state to the host apparatus 100. The transmission of these kinds of information to the host apparatus 100 by the printer 200 enables the host apparatus 100 to know the state of the printer 200. Therefore, by transmitting an inspection result acquisition command again after the lapse of predetermined time, the host apparatus 100 is able to acquire information on the inspection results from the printer 200.

Figure 2:
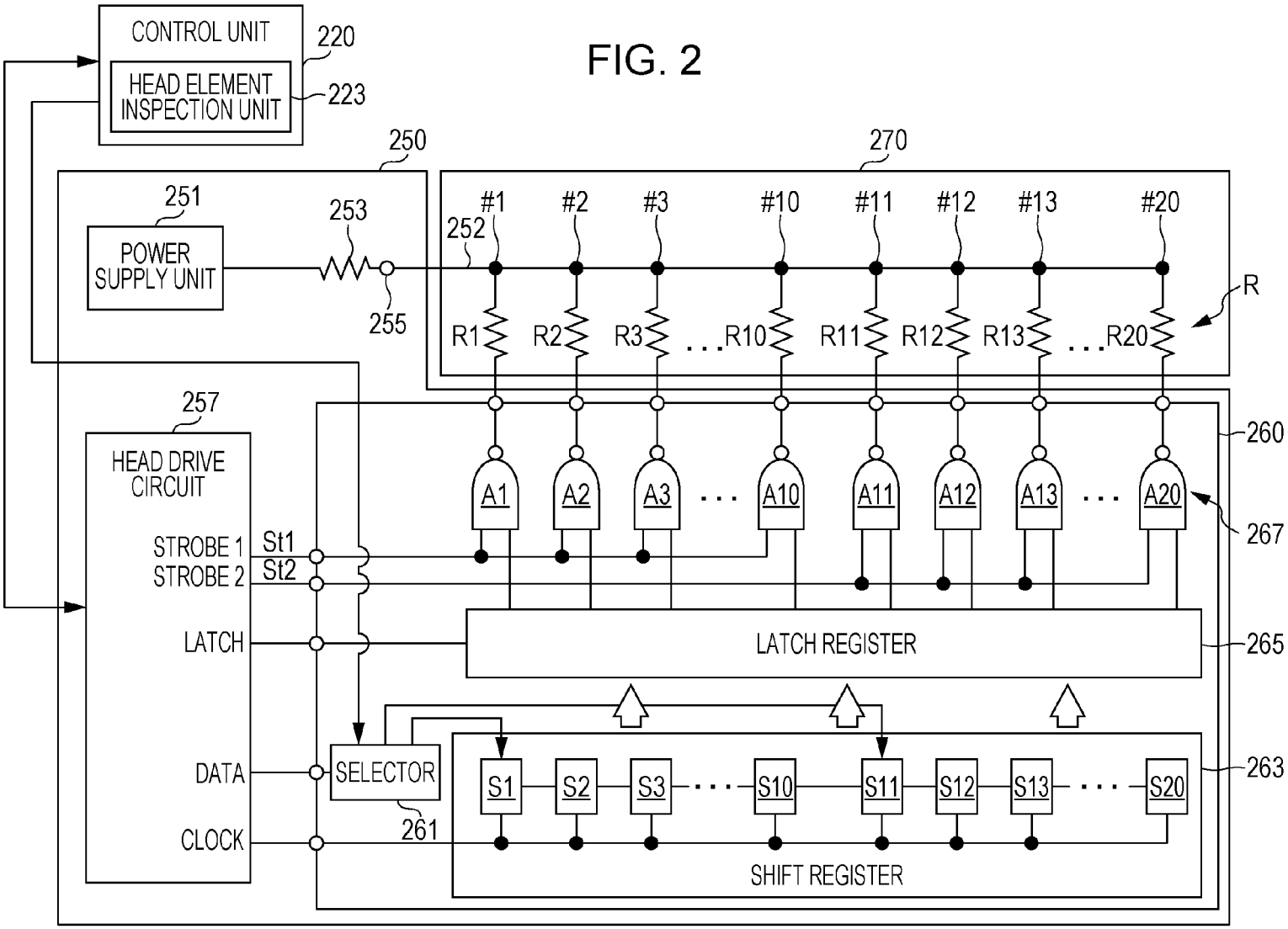
FIG. 2 is a diagram illustrating an example of the configuration of a thermal line head and a head driver.

FIG. 2 is a diagram illustrating an example of the configuration of the thermal line head 270 and the head driver 250. The thermal line head 270 includes a plurality of heat generation elements #1 to #n (where n denotes arbitrary natural number). Each of the plurality of heat generation elements #1 to #n is provided with the corresponding one of a plurality of resistors R1 to Rn. Printing is performed on thermosensitive paper by selective electric energization of the resistors R1 to Rn. In the example of FIG. 2, heat generation elements #1 to #20 are illustrated as the plurality of heat generation elements mentioned above, and resistors R1 to R20 are illustrated as the plurality of resistors mentioned above. In the description below, the resistors R1 to Rn are denoted as "resistors R" when collectively referred to. One end of each of the resistors R1 to Rn is connected to a common electrode 252. The other end of each of the resistors R1 to Rn is connected to a driver IC 260 provided in the head driver 250.

The head driver 250 includes a power supply unit 251, a head drive circuit 257, and the driver IC 260. The power supply unit 251 is connected to the common electrode 252 via a resistor 253, and supplies a power voltage (hereinafter referred to as "head voltage") to each of the heat generation elements #1 to #n connected to the common electrode 252. At the point of connection between the resistor 253 and the common electrode 252, a voltage (current) measurement point 255 for measurement of a voltage (current) value by a non-illustrated voltage (current) measurement unit is provided. The voltage (current) measurement unit measures either a voltage at the voltage measurement point 255 or a current flowing through the current measurement point 255. A non-illustrated A/D (analog-to-digital) conversion unit applies A/D conversion to the value of the voltage (current) measured by the voltage (current) measurement unit. The converted value is inputted into the head element inspection unit 223.

The head drive circuit 257 outputs, to the driver IC 260, signals for selective electric energization of the heat generation elements #1 to #n of the thermal line head 270. The signals outputted by the head drive circuit 257 include a clock signal CLK, output pixel data, a latch signal LAT, a strobe signal St1, and a strobe signal St2. These signals will be described in detail later.

In accordance with signal outputs from the head drive circuit 257, the driver IC 260 selectively energizes the heat generation elements #1 to #n. The driver IC 260 includes a selector 261, a shift register 263, a latch register 265, and a drive circuit 267.

The selector 261 is connected to the control unit 220, the head drive circuit 257, and the shift register 263. The selector 261 receives an input of print bit data, which is outputted from the data terminal (DATA) of the head drive circuit 257. Under the control of the control unit 220, the selector 261 changes a shift register cell of the shift register 263 to which the inputted print bit data is outputted. This processing will be described in detail later.

The shift register 263 includes a plurality of shift register cells S1 to Sn. The number of the shift register cells S1 to Sn is equal to the number of the heat generation elements #1 to #n. In the example of FIG. 2, shift register cells S1 to S20 are illustrated as the plurality of shift register cells mentioned above. In the description below, the shift register cells S1 to Sn are denoted as "shift register cells S" when collectively referred to. A clock signal CLK is inputted from the clock terminal (CLOCK) of the head drive circuit 257 into the shift register 263. In addition, pieces of bit data constituting print bit data are serially inputted via the selector 261 into the shift register 263. The output terminal of each of the shift register cells S is connected to the latch register 265.

The latch register 265 includes a plurality of latch circuits L1 to Ln (not illustrated). The number of the latch circuits L1 to Ln is equal to the number of the heat generation elements #1 to #n. In the description below, the latch circuits L1 to Ln are denoted as "latch circuits L" when collectively referred to. A latch signal LAT, which is outputted from the latch terminal (LATCH) of the head drive circuit 257, is inputted into the latch register 265. Using the latch signal LAT as a trigger, the latch register 265 latches the bit data retained by each of the shift register cells S1 to Sn into the corresponding one of the latch circuits L1 to Ln. Specifically, the bit data retained by the shift register cell S1 is latched into the latch circuit L1, and the bit data retained by the shift register cell S2 is latched into the latch circuit L2.

Similar operation is performed, and the bit data retained by the shift register cell Sn is latched into the latch circuit Ln.

The drive circuit 267 includes a plurality of drive elements A1 to An. The number of the drive elements A1 to An is equal to the number of the heat generation elements #1 to #n. In the example of FIG. 2, drive elements A1 to A20 are illustrated as the plurality of drive elements mentioned above. In the description below, the drive elements A1 to An are denoted as "drive elements A" when collectively referred to. Either a strobe signal St1, which is outputted from the head drive circuit 257, or a strobe signal St2, which is also outputted from the head drive circuit 257, is inputted into the drive element A1, . . . An. In the description below, the strobe signal St1 and the strobe signal St2 are denoted as "strobe signals St" when collectively referred to. In addition, the bit data retained by the corresponding one of the latch circuits L1 to Ln is inputted into each of the drive elements A1 to An. Specifically, the bit data retained by the latch circuit L1 is inputted into the drive element A1, and the bit data retained by the latch circuit L2 is inputted into the drive element A2. Similar operation is performed, and the bit data retained by the latch circuit Ln is inputted into the drive element An. The output terminals of the drive elements A1 to An are connected respectively to the resistors R1 to Rn of the heat generation elements #1 to #n.

The heat generation elements #1 to #n are divided into blocks based on unit of concurrent electric energization. The heat generation elements #1 to #n are divided into blocks by utilizing the strobe signals St. In the example of FIG. 2, the heat generation elements #1 to #20 are grouped into two blocks, Block 1 and Block 2. In the description below, it is assumed that the heat generation elements #1 to #10 belong to Block 1 and that the heat generation elements #11 to #20 belong to Block 2. However, the number of heat generation elements belonging to Block is not limited to ten. The heat generation elements #1 to #10 belonging to Block 1 are connected respectively to the drive elements A1 to A10, and the strobe signal St1 is inputted into these respective drive elements for the heat generation elements #1 to #10. The heat generation elements #11 to #20 belonging to Block 2 are connected respectively to the drive elements A11 to A20, and the strobe signal St2 is inputted into these respective drive elements for the heat generation elements #11 to #20. The strobe signal St1 and the strobe signal St2 are signals for switching the drive elements A1 to An between ON and OFF. For example, let it be supposed that the signal level of the strobe signal St1 is set to be "Hi" (High) and that the signal level of the strobe signal St2 is set to be "Low". In this case, among the heat generation elements #1 to #10 connected respectively to the drive elements A1 to A10, heat generation elements #1 to #10 connected respectively to drive elements A1 to A10 retaining bit data "1" are energized concurrently. When this concurrent energization occurs, the heat generation elements #11 to #20 are not energized because the strobe signal St2 is in the "Low" level. Similarly, for example, let it be supposed that the signal level of the strobe signal St2 is set to be "Hi" and that the signal level of the strobe signal St1 is set to be "Low". In this case, among the heat generation elements #11 to #20 connected respectively to the drive elements A11 to A20, heat generation elements #11 to #20 connected respectively to drive elements A11 to A210 retaining bit data "1" are energized concurrently. When this concurrent energization occurs, the heat generation elements #1 to #10 are not energized because the strobe signal St1 is in the "Low" level. To print an image based on print data on thermosensitive paper, first, the electric energization control unit 222 controls the selector 261 to set the shift register cell S1 of the shift register 263 as the output destination for print bit data inputted from the head drive circuit 257 and outputted by the selector 261. Next, the electric energization control unit 222 outputs print bit data stored in the print buffer 231 and control data to the head drive circuit 257. The control data contains, for example, description on the timing of latching the print bit data into the latch register 265, the timing of switching the strobe signal St1, St2 ON, and the like.

In synchronization with the clock signal CLK, the head drive circuit 257 outputs the received print bit data to the selector 261, one bit after another in sequence. Under the control of the electric energization control unit 222, the selector 261 outputs the inputted print bit data to the shift register cell S1 of the shift register 263. The shift register 263 shifts the print bit data inputted sequentially from the selector 261 in synchronization with the clock signal CLK, thereby causing the shift register cells S1 to Sn constituting the shift register 263 to retain print bit data corresponding to one line.

At the timing when print bit data corresponding to one line has been retained by the shift register 263, the head drive circuit 257 outputs the latch signal LAT to the latch register 265. Triggered by the latch signal LAT inputted from the head drive circuit 257, the latch register 265 latches the print bit data corresponding to one line inputted from the shift register 263.

Next, the head drive circuit 257 changes the signal level of the strobe signal St1, St2 outputted to the drive circuit 267 from the "Low" level to the "Hi" level. When the signal level of the strobe signal St1, St2 turns "Hi", among the drive elements A1 to An, drive elements A1 to An connected respectively to latch circuits L1 to Ln retaining bit data "1" are turned ON. When the drive elements A1 to An are turned ON, an electric current flows via the common electrode 252 through the heat generation elements #1 to #n connected respectively to the drive elements A1 to An turned ON. As a result of this current flow, heat is generated by the resistors R of, among the heat generation elements #1 to #n, the heat generation elements corresponding to the ON print bit data. By this means, dots are formed on thermosensitive paper.

Next, a missing-dot inspection conducted by the head element inspection unit 223 will now be explained. The head element inspection unit 223 conducts a missing-dot inspection of the thermal line head 270. "Missing-dot inspection" is an inspection for finding a defective element by detecting a change in the resistance value of each of the resistors R1 to Rn provided in the thermal line head 270. Aged deterioration causes an increase in the resistance value of each of the resistors R1 to Rn provided in the thermal line head 270. There will be a greater increase in the resistance value of the resistor R1, . . . Rn in the event of a static damage or a wire breakage. The resistor R1, . . . Rn with such an increase in resistance is referred to as "defective element" herein. If a defective element is used for performing printing, it is impossible to form a dot at the defective element, resulting in a so-called missing-dot failure. In the description below, missing-dot inspection may be simply referred to as "inspection".

Figure 3:
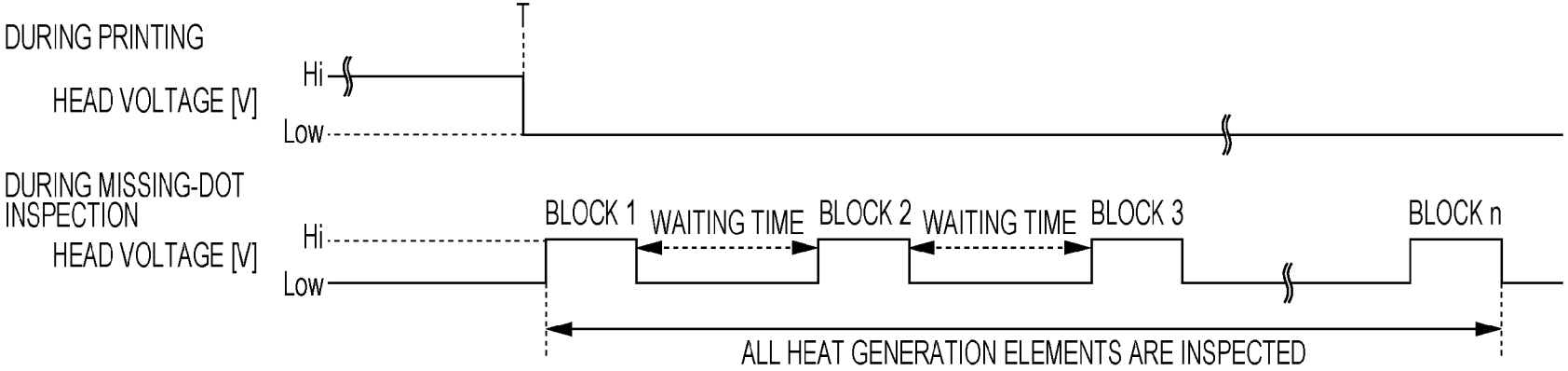
FIG. 3 is a diagram illustrating an example of the timing of execution of a missing-dot inspection.
Figure 4:
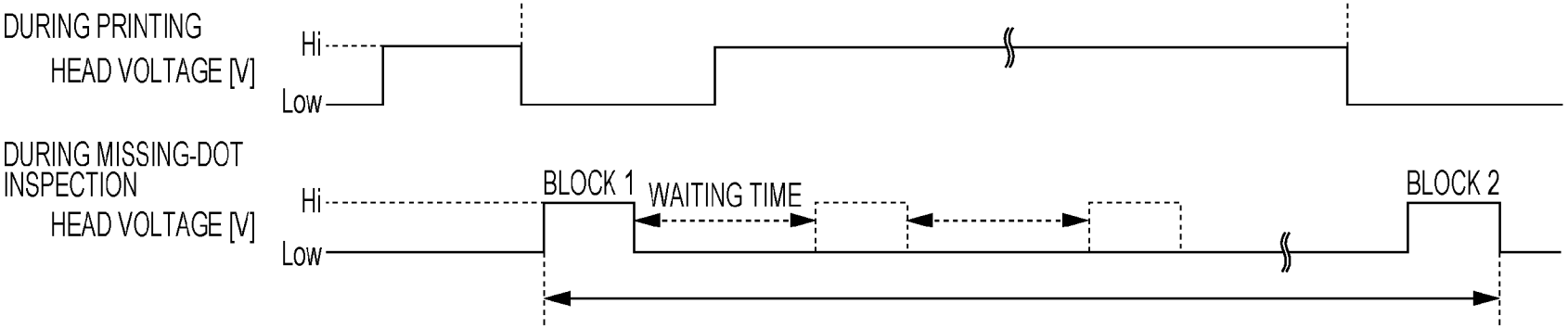
FIG. 4 is a diagram illustrating an example of the timing of execution of a missing-dot inspection.

The head element inspection unit 223 inspects the heat generation elements of the thermal line head 270 on a block-by-block basis. The head element inspection unit 223 selects a target block that is to be inspected (hereinafter referred to as "inspection block"), and inspects heat generation elements that are included in the selected inspection block. After completion of the inspection of the heat generation elements included in the inspection block, the head element inspection unit 223 waits for the lapse of preset waiting time before execution of the inspection of the next inspection block. After waiting for the lapse of the waiting time, on the basis of print data, the head element inspection unit 223 judges whether to inspect the heat generation elements included in the next inspection block or not. With reference to FIGS. 3 and 4, a method of judging on the basis of print data whether to execute an inspection of Block 2 or not will now be explained.

Each of FIGS. 3 and 4 is a diagram illustrating an example of the timing of execution of a missing-dot inspection. More specifically, a case where print data is not received during the execution of a missing-dot inspection is illustrated in FIG. 3, and a case where print data is received during the execution of a missing-dot inspection is illustrated in FIG. 4. The head element inspection unit 223 judges that the printing of print data has ended in a case where the operation of printing an image based on the print data has ended, where the head voltage of the power supply unit 251 has been changed into the "Low" level (timing T in FIG. 3), and where the driving of the transportation motor 236 has stopped. Then, the head element inspection unit 223 starts to inspect Block 1, which is the inspection block. In the present embodiment, the inspection block is selected sequentially in the order of Block 1, Block 2, Block 3, . . . Block n. However, it is not always necessary to select the inspection block sequentially in the order of Block 1, Block 2, Block 3, . . . Block n. For example, the inspection block may be selected sequentially in the order of Block n, Block n-1, Block n-2, . . . Block 1.

To conduct an inspection, first, the head element inspection unit 223 causes the head drive circuit 257 to output inspection bit data. Under the control of the head element inspection unit 223, the head drive circuit 257 outputs inspection bit data from the data terminal (DATA). The inspection bit data is data for inspection, the first bit of which is "1" and the second and subsequent bits of which are "0". The number of bits in the inspection bit data is equal to the number of heat generation elements belonging to the target block to be inspected (referred to as "inspection block" herein). For example, in a case where the inspection block includes ten heat generation elements, the head drive circuit 257 outputs 10-bit inspection bit data as the inspection bit data mentioned above.

Under the control of the head element inspection unit 223, the selector 261 outputs the inputted inspection bit data to the first one of shift register cells S belonging to the inspection block. For example, in a case where the inspection block is Block 1, the selector 261 outputs the inspection bit data to the shift register cell S1, one bit after another in sequence. In a case where the inspection block is Block 2, the selector 261 outputs the inspection bit data to the shift register cell S11, one bit after another in sequence.

The shift register 263 shifts the inspection bit data inputted sequentially from the selector 261 in synchronization with the clock signal CLK. That is, the inspection bit data is shifted sequentially through the shift register cells S1 to S10 in synchronization with the clock signal CLK.

In a case where the inspection block is Block 1, the head drive circuit 257 switches the signal level of the strobe signal St1 from "Low" to "Hi". In this case, the head drive circuit 257 maintains the signal level of the strobe signal St2 at "Low". Moreover, the head drive circuit 257 does not output the latch signal LAT during the execution of a missing-dot inspection.

The ON duration of the drive element A depends on the pulse width of the strobe signal St outputted by the head drive circuit 257. The pulse width of the strobe signal St outputted by the head drive circuit 257 is shorter than the pulse width during printing on thermosensitive paper. By this means, in synchronization with the clock signal CL outputted by the head drive circuit 257, the drive elements A1 to A10 are switched ON sequentially, thereby energizing the heat generation elements #1 to #10 sequentially only during the outputting of the strobe signal St1 by the head drive circuit 257. Therefore, the heat generation elements #1 to #10 are energized one by one in sequence.

During the sequential electric energization of the heat generation elements #1 to #10, the voltage (current) at the voltage (current) measurement point 255 is measured. In a case of voltage measurement by the head element inspection unit 223, the value of the voltage measured at the voltage (current) measurement point 255 is acquired, a current value is calculated from a potential difference between a predetermined output voltage of the power supply unit 251 and the acquired voltage value and from a predetermined resistance value of the resistor 253, and the current value is subtracted from the output voltage of the power supply unit 251 to calculate the resistance value for each of the heat generation elements #1 to #10. In a case of current measurement by the head element inspection unit 223, the value of the current measured at the voltage (current) measurement point 255 is acquired, a voltage value is calculated by subtracting a result of multiplication of the acquired current value by a predetermined resistance value of the resistor 253 from a predetermined output voltage of the power supply unit 251, and the acquired current value is subtracted from the voltage value to calculate the resistance value for each of the heat generation elements #1 to #10. As described above, the head element inspection unit 223 calculates the resistance value of each of the resistors R1 to Rn on the basis of either the voltage value or the current value detected at the voltage (current) measurement point 255, on the basis of the output voltage of the power supply unit 251, and on the basis of the resistance value of the resistor 253. Then, the head element inspection unit 223 judges, as a defective element, each heat generation element showing a resistance value greater than a preset threshold value. The head element inspection unit 223 causes the RAM to store the element number (No.) of the heat generation element judged as a defective element. Before the printer 200 is powered OFF, the head element inspection unit 223 causes the storage unit 280 to memorize the element number of the heat generation element judged as a defective element.

Upon completion of the inspection of the heat generation elements included in Block 1, the head element inspection unit 223 commands that the head voltage should be stopped, and waits for the lapse of preset waiting time before execution of the inspection of the heat generation elements included in Block 2, which is the next inspection block. The waiting time has been set in advance for the purpose of suspending the ongoing missing-dot inspection to print an image based on print data in a case of receiving the print data during the missing-dot inspection. If a missing-dot inspection were conducted continuously for plural blocks, in a case of receiving print data during the missing-dot inspection, the printing of an image based on the print data would be postponed until completion of the missing-dot inspection. The preset waiting time is longer than the time taken for generating print bit data corresponding to one line on the basis of received print data and rendering the generated print bit data corresponding to one line onto the print buffer 231 by the print control unit 221. Since the waiting time is preset to have the length described above, in a case of receiving print data after completion of the inspection of a certain inspection block, it is possible to start the printing of the received print data before the inspection of the next inspection block starts. By this means, it is possible to reduce the time taken until the print data is printed out.

After waiting for the lapse of the waiting time without executing the missing-dot inspection continuously, the head element inspection unit 223 judges whether there is any rendering of print bit data onto the print buffer 231 or not. In a case where there is some rendering of print bit data onto the print buffer 231, the head element inspection unit 223 further judges whether print bit data corresponding to one line has been rendered onto the print buffer 231 or not and whether it is therefore possible to start print processing or not. In a case where the print bit data corresponding to one line has not been rendered onto the print buffer 231 yet although there is some rendering of print bit data onto the print buffer 231, the head element inspection unit 223 inspects the heat generation elements included in Block 2, which is the next block that follows the one that was inspected before the suspension. FIG. 3 illustrates a case where the head element inspection unit 223 executes the inspection of the heat generation elements included in Block 2, which is the next inspection block, after waiting for the lapse of the waiting time because of the absence of rendered print bit data on the print buffer 231.

In a case where print bit data corresponding to one line has been rendered onto the print buffer 231 and where it is therefore possible to start print processing, the head element inspection unit 223 executes print processing by suspending the inspection procedure and postponing the inspection of the heat generation elements included in Block 2, which is the next inspection block. FIG. 4 illustrates a case where, during waiting after completion of the inspection of Block 1 and before execution of the inspection of Block 2, which is the next inspection block, print bit data corresponding to one line has been rendered onto the print buffer 231. In this case, the head element inspection unit 223 suspends the inspection procedure for Block 2 and subsequent blocks. Printing processing ends at the timing T2, and the head element inspection unit 223 thereafter resumes the inspection procedure, starting from Block 2.

Figure 5:
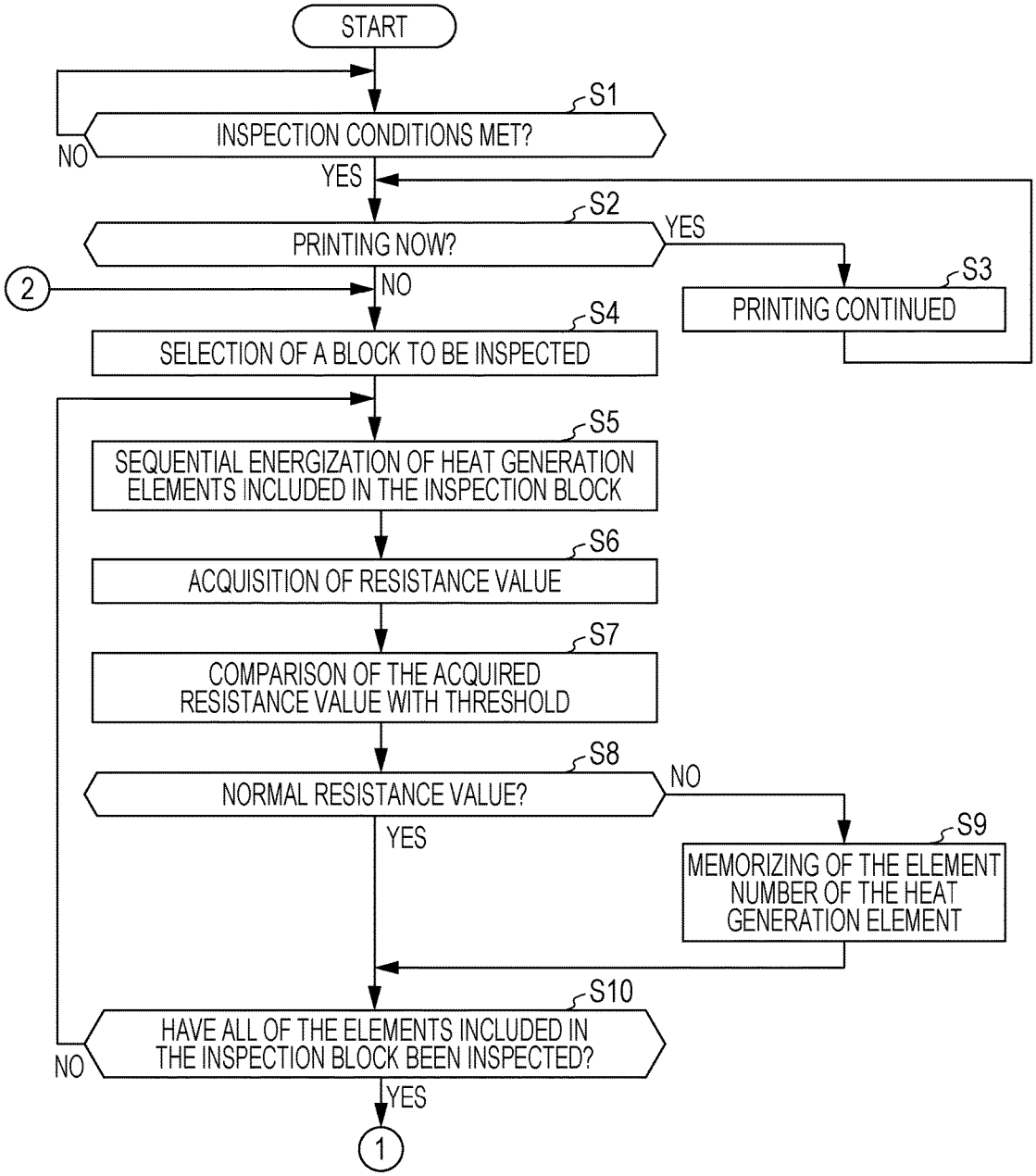
FIG. 5 is a flowchart illustrating the operation of a printer according to a first embodiment.
Figure 6:
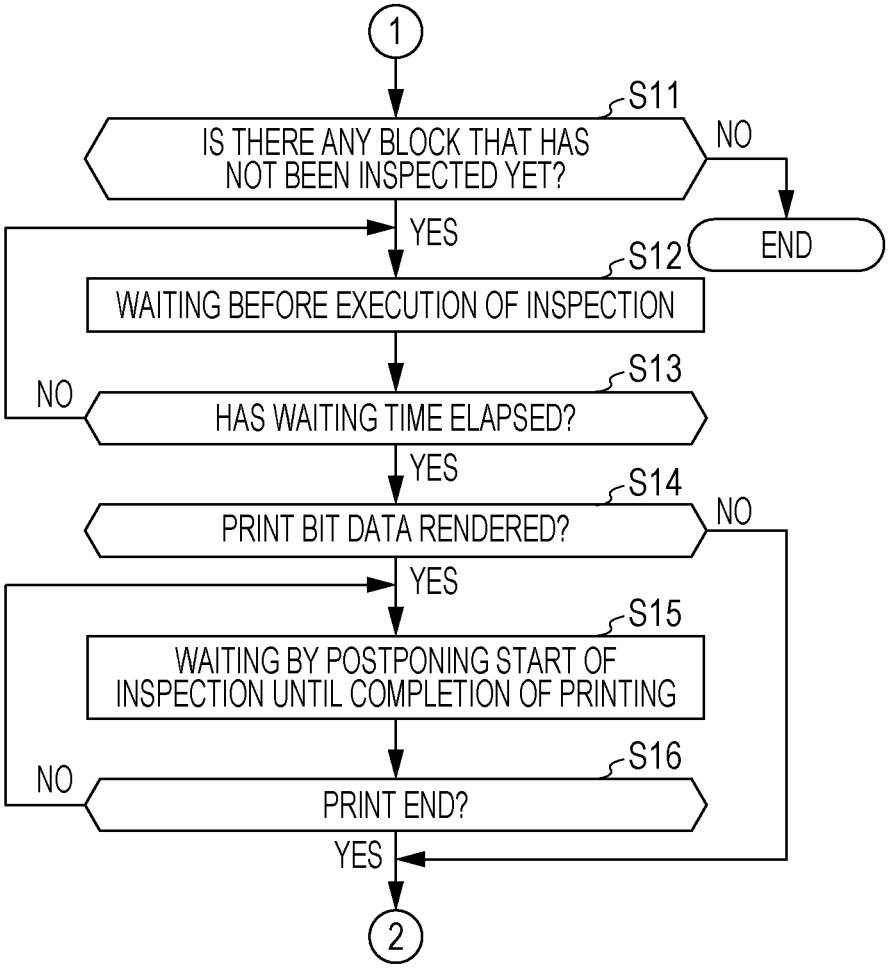
FIG. 6 is a flowchart illustrating the operation of a printer according to a first embodiment.

FIGS. 5 and 6 are a set of flowcharts illustrating the operation of the printer 200 when a missing-dot inspection is conducted. The head element inspection unit 223 judges whether inspection conditions are met or not (step S1). For example, it is judged whether the number of lines printed by the printer 200 has reached a preset number of lines or not. If the inspection conditions are not met (step S1: NO), the head element inspection unit 223 waits until the inspection conditions are met. If the inspection conditions are met (step S1: YES), the head element inspection unit 223 judges whether the printing of print data is currently being performed or not (step S2). It is checked whether the driving of the transportation motor 236 has stopped or not, and the above judgment as to whether the printing of print data is currently being performed or not is made on the basis of the check result. The head element inspection unit 223 may inquire of the motor driver 235 whether power is supplied to the transportation motor 236 or not and may judge that the driving of the transportation motor 236 has stopped if no power is supplied by the motor driver 235 to the transportation motor 236. Alternatively, for example, a non-illustrated sensor may detect an electric current supplied to the transportation motor 236, and the head element inspection unit 223 may judge whether the driving of the transportation motor 236 has stopped or not on the basis of a detection value outputted by the sensor. The head element inspection unit 223 may judge that the printing of print data is not being performed if the transportation motor 236 is in a hold state. The hold state means a state in which power is supplied to the transportation motor 236 although the rotation of the transportation motor 236 has stopped and in which the transportation motor 236 keeps its stop state. The head element inspection unit 223 makes a query about the driving voltage of the transportation motor 236 to the motor driver 235. On the basis of a reply of the driving voltage from the motor driver 235, the head element inspection unit 223 judges whether the transportation motor 236 is in a hold state or not. If the printing of print data is currently being performed (step S2: YES), the head element inspection unit 223 postpones the start of a missing-dot inspection and continues the printing of print data (step S3).

If the printing of print data is not being performed (step S2: NO), the head element inspection unit 223 selects an inspection block that is to be inspected (step S4). In a case where a preceding block that has already been inspected exists, the next block that follows the block that has already been inspected is selected as the inspection block. In a case where a preceding block that has already been inspected does not exist, Block 1 is selected as the inspection block.

Next, the head element inspection unit 223 energizes each heat generation element included in the selected inspection block in turn (step S5), and acquires the resistance value of the energized heat generation element (step S6). Upon acquisition, the head element inspection unit 223 compares the acquired resistance value with a threshold value (step S7). If the acquired resistance value is not greater than the threshold value, the head element inspection unit 223 judges that the acquired resistance value is a normal value (step S8: YES). In this case, the process proceeds to a judgment in a step S10. If the acquired resistance value is greater than the threshold value, the head element inspection unit 223 judges that the acquired resistance value is an abnormal value (step S8: NO). The head element inspection unit 223 judges, as a defective element, the heat generation element the resistance of which is abnormal, and causes the RAM to store the element number of the heat generation element that is defective (step S9).

Next, the head element inspection unit 223 judges whether the inspection on resistance has been completed for all of the heat generation elements included in the inspection block or not (step S10). If the inspection on resistance has not been completed for all of the heat generation elements included in the inspection block (step S10: NO), the process returns to the step S5, and the head element inspection unit 223 energizes the next one among the heat generation elements included in the inspection block (step S5) to acquire the resistance value of the energized heat generation element (step S6).

If the inspection on resistance has been completed for all of the heat generation elements included in the inspection block (step S10: YES), the head element inspection unit 223 judges whether there is any block that has not been inspected yet or not (step S11). If there is any block that has not been inspected yet (step S11: YES), the head element inspection unit 223 waits for the lapse of preset waiting time without executing the inspection continuously (step S12). If there is no block that has not been inspected yet (step S11: NO), the head element inspection unit 223 terminates the missing-dot inspection.

The head element inspection unit 223 judges whether the preset waiting time has elapsed or not (step S13). If the preset waiting time has not elapsed (step S13: NO), the head element inspection unit 223 waits for the lapse of the preset waiting time. If the preset waiting time has elapsed (step S13: YES), the head element inspection unit 223 judges the presence or absence of rendered print bit data on the print buffer 231 (step S14). In a case where print data has been received during waiting for the lapse of the preset waiting time without executing the inspection continuously, the print control unit 221 generates print bit data on the basis of the received print data and renders the generated print bit data onto the print buffer 231. In a case of the presence of rendered print bit data on the print buffer 231 (step S14: YES), the head element inspection unit 223 postpones the start of an inspection and waits until the printing of an image based on the received print data finishes (step S15). Next, the head element inspection unit 223 judges whether the printing of the image has finished or not (step S16). If the printing of the image has not finished yet (step S16: NO), the process returns to the step S15, and the head element inspection unit 223 waits, without starting the inspection, until the printing ends (step S15). If the printing of the image has finished (step S16: YES), the process returns to the step S4, and the head element inspection unit 223 selects an inspection block that is to be inspected (step S4) and energizes each heat generation element included in the selected inspection block in turn (step S5).

In a case of the absence of rendered print bit data on the print buffer 231 (step S14: NO), the process returns to the step S4, and the head element inspection unit 223 selects an inspection block that is to be inspected (step S4) and energizes each heat generation element included in the selected inspection block in turn (step S5).

As explained above, a first embodiment to which a printer and a printer control method according to an aspect of the invention is applied includes the I/F unit 210, the thermal line head 270, and the head element inspection unit 223. The I/F unit 210 receives print data. The thermal line head 270 includes the plurality of resistors R and prints an image based on the received print data on thermosensitive paper that is transported, the plurality of resistors R being divided into unit of being able to be energized concurrently. The head element inspection unit 223 performs inspection, with the plurality of resistors R divided into the unit, to acquire a resistance value of each resistor R belonging to the unit on a unit-by-unit basis. When the image is not being printed by the thermal line head 270, the head element inspection unit 223 inspects the resistors R in the unit of division each. On the basis of the print data, the head element inspection unit 223 suspends the inspection of the resistors on the unit-by-unit basis. After completion of the printing of the image by the thermal line head 270, the head element inspection unit 223 resumes the suspended inspection on the unit-by-unit basis from where suspended. Therefore, it is possible to reduce the time of postponement, due to the inspection of the thermal line head 270, of the printing of print data.

The head element inspection unit 223 suspends the inspection when the image based on the print data is printed by the thermal line head 270. Therefore, it is possible to reduce the time of postponement, due to the inspection of the thermal line head 270, of the printing of print data, and possible to continue the inspection of the thermal line head 270 until just before an image based on the print data is printed.

The printer 200 includes the print control unit 221 and the print buffer 231 for rendering the print data into data printable by the thermal line head 270. The head element inspection unit 223 inspects the resistors R in the unit of division each in a predetermined cycle. The length of a period during which the inspection is not performed by the head element inspection unit 223 is preset to be greater than the length of time taken for rendering into data corresponding to one line by the print control unit 221. Therefore, it is possible to increase the probability that the printing of received print data will be performed without performing the inspection of the resistors R in a case of receiving the print data during the period during which the inspection is not performed.

Upon receiving a predetermined command by the I/F unit 210, inspected status of the resistors R each is acquired by the head element inspection unit 223, and the I/F unit 210 transmits information that indicates the acquired inspected status of the resistors R each to a transmission destination specified by the predetermined command. Therefore, the printer 200 is able to transmit the information that indicates the inspected status of the resistors R to the host apparatus 100 that is an external apparatus.

In a case where the inspection of the resistors R of the thermal line head 270 by the head element inspection unit 223 has not finished yet when the predetermined command is received by the I/F unit 210, either information that indicates that the inspection of the resistors R has not finished yet or information that indicates that the inspection of the resistors R has not been confirmed yet is transmitted by I/F unit 210 to the host apparatus 100. Therefore, the host apparatus 100 is able to acquire the information that indicates the inspected status of the resistors R by transmitting the predetermined command to the printer 200 again after a predetermined time interval.

The printer 200 further includes the motor driver 235 that drives the transportation motor 236 to transport thermosensitive paper to a print position of the thermal line head 270. The head element inspection unit 223 performs the inspection of the resistors R either when the transportation motor 236 has stopped or when the transportation motor 236 has been put into a hold state. Therefore, it is possible to judge, with high precision, the timing at which the printing of print data is not being performed.

Second Embodiment

Next, a second embodiment, which is another example of embodiments of the invention, will now be explained. Since the configuration of a printer 200 according to a second embodiment is the same as that of the first embodiment described above, it is not explained here. In FIGS. 5 and 6, which are a set of flowcharts illustrating the operation of the printer 200 according to the first embodiment, it is judged whether to execute the inspection of the next inspection block or not depending on whether the rendering of print bit data onto the print buffer 231 has finished or not. In the second embodiment, in a case of receiving print data from the host apparatus 100 during waiting for the lapse of waiting time before execution of the inspection of the next inspection block, the inspection procedure is suspended by postponing the inspection of the next inspection block, and print processing for outputting the received print data is executed.

Figure 7:
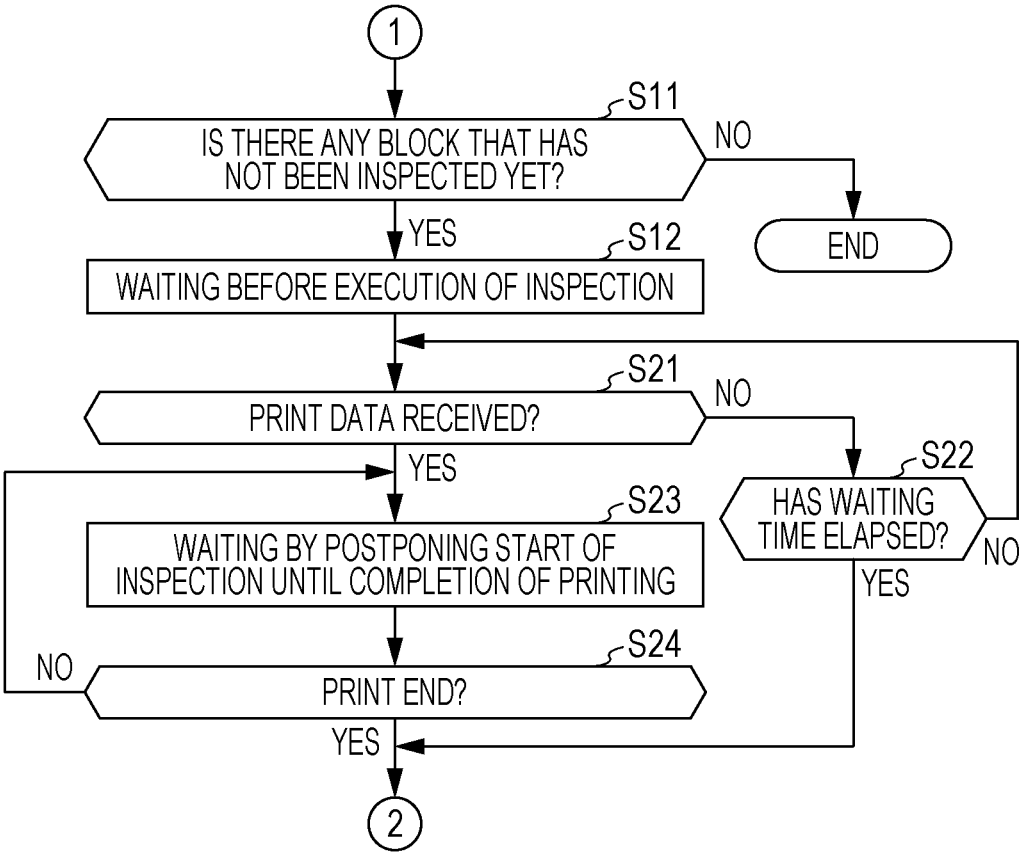
FIG. 7 is a flowchart illustrating the operation of a printer according to a second embodiment.

FIG. 7 is a chart illustrating a processing flow of, in a case of receiving print data, suspending the inspection procedure by postponing the inspection of the next inspection block, and executing print processing. Processing in the steps S1 to S12 in FIG. 7 is the same as processing in the steps S1 to S12 in FIGS. 5 and 6. Therefore, an explanation of these steps is omitted here. If there is any block that has not been inspected yet (step S11: YES), the head element inspection unit 223 waits for the lapse of preset waiting time without executing the inspection continuously (step S12).

The head element inspection unit 223 judges whether there is any print data received during waiting for the lapse of waiting time before execution of the inspection of the next inspection block or not (step S21). In a case where there is no print data received (step S21: NO), the head element inspection unit 223 judges whether the waiting time has elapsed or not (step S22). If the waiting time has not elapsed (step S22: NO), the process returns to the step S21, and the head element inspection unit 223 judges whether there is any print data received or not (step S21). If the waiting time has elapsed (step S22: YES), the process returns to the step S4 in FIG. 5, and the head element inspection unit 223 selects an inspection block that is to be inspected (step S4) and energizes each heat generation element included in the selected inspection block in turn (step S5).

If it is judged in the step S21 that there is print data received (step S21: YES), the head element inspection unit 223 postpones the start of an inspection and waits until the printing of an image finishes (step S23). Upon completion of the printing, the process returns to the step S4, and the head element inspection unit 223 selects an inspection block that is to be inspected (step S4) and energizes each heat generation element included in the selected inspection block in turn (step S5).

As described above, in the present embodiment, the head element inspection unit 223 judges whether there is any print data received or not, and suspends the inspection procedure if it is judged that there is print data received. Therefore, it is possible to further reduce the time of postponement, due to the inspection of the thermal line head 270, of the printing of print data.

The foregoing first and second embodiments are preferred embodiments of the invention. The scope of the invention is not limited to these embodiments. Various modifications, etc. may be made within a range of not departing from the gist of the invention.

For example, although one line is taken as unit of printing an image based on print data by the printer 200 in the foregoing first and second embodiments, the printer 200 may be configured to perform image printing on a block-by-block basis.

The flow in the flowchart of FIGS. 5, 6, and 7 is divided into processes in accordance with the main content of processing in order to facilitate the understanding of processing performed by the control unit 220 of the printer 200. The way of division into the processes and the name of them should never be construed as specific limitations on the scope of the invention. Depending on the content of processing, processing performed by the control unit 220 may be divided into more processes, and/or one process may include more than one kind of processing. The sequential order of processing in the flowchart described above is not limited to the illustrated example.

Each functional unit illustrated in FIGS. 1 and 2 shows a functional configuration, and a specific manner of its implementation is not limited. That is, it is not always necessary that hardware corresponding individually to each functional unit be provided. As a matter of course, a single processor may realize the functions of a plurality of functional units by running a program or programs. A part of functions implemented by software in the foregoing embodiment may be implemented by hardware. A part of functions implemented by hardware in the foregoing embodiment may be implemented by software. The specific detailed configuration of other units of the printer 200 also may be modified as may be necessary within a range of not departing from the gist of the invention.

What is claimed is:

1. A thermal printer, comprising:

a communication section configured to receive print data;

a thermal line head configured to include a plurality of resistors and print an image based on the received print data on thermosensitive paper, the plurality of resistors being divided into at least a first unit and a second unit, each being able to be energized concurrently; and an inspection section configured to perform inspection, with the plurality of resistors divided into the first and second units, to acquire a resistance value of each resistor belonging to the same unit on a unit-by-unit basis, wherein, when the image is not being printed by the thermal line head, the inspection section inspects the resistors in the respective one of the first and second units, wherein the inspection of the resistors is suspended on a basis of when the print data is received after the first unit has been inspected and before the second unit has not yet been inspected; and wherein, after completion of the printing of the image by the thermal line head, the suspended inspection is resumed on the unit-by-unit basis from where suspended.

2. The thermal printer according to claim 1, wherein the inspection section suspends the inspection when the image based on the print data is printed by the thermal line head.

3. The thermal printer according to claim 1, further comprising:

a rendering section configured to render the print data into data printable by the thermal line head, wherein the inspection section inspects the resistors in each of the first and second units in a predetermined cycle; and wherein a length of a period during which the inspection is not performed by the inspection section is preset to be greater than a length of time taken for rendering into the data of a predetermined unit amount by the rendering section.

4. The thermal printer according to claim 1, wherein, upon receiving a predetermined command by the communication section, inspected status of the resistors each is acquired by the inspection section, and the communication section transmits information that indicates the acquired inspected status of the resistors each to a transmission destination specified by the predetermined command.

5. The thermal printer according to claim 4, wherein, in a case where the inspection of the resistors of the thermal line head by the inspection section has not finished yet when the predetermined command is received by the communication section, either information that indicates that the inspection of the resistors has not finished yet or information that indicates that the inspection of the resistors has not been confirmed yet is transmitted by the communication section to the transmission destination.

6. The thermal printer according to claim 1, further comprising:

a driving section configured to drive a motor to transport the thermosensitive paper to a print position of the thermal line head, wherein the inspection section performs the inspection of the resistors either when the motor has stopped or when the motor has been put into a hold state.

* * * * *